United States Patent [19]

Franchi

[11] Patent Number: 4,462,501

[45] Date of Patent: Jul. 31, 1984

[54] CHILD PROOF MEDICINE VIAL

[76] Inventor: Roberto D. Franchi, 167 Pequot Ter., Stonington, Conn. 06378

[21] Appl. No.: 508,753

[22] Filed: Jun. 28, 1983

[51] Int. Cl.[3] ..... B65D 55/02; B65D 85/56; A61J 1/00

[52] U.S. Cl. ..... 215/296; 206/540; 206/807; 206/459; 206/534; 215/215; 215/299; 215/302; 220/284; 220/285

[58] Field of Search ..... 206/540, 807, 459, 534; 215/201, 215, 296, 299, 302; 220/284, 285

[56] References Cited

U.S. PATENT DOCUMENTS

| | | | |
|---|---|---|---|
| 3,313,441 | 4/1967 | Fadden | 206/540 |
| 3,625,386 | 12/1971 | Schaefer | 215/215 |
| 3,843,008 | 10/1974 | Colella | 215/215 |

FOREIGN PATENT DOCUMENTS

| | | | |
|---|---|---|---|
| 1302D | of 1910 | United Kingdom | 215/296 |

*Primary Examiner*—William T. Dixson, Jr.
*Attorney, Agent, or Firm*—Sughrue, Mion, Zinn, Macpeak, and Seas

[57] ABSTRACT

A child proof medicine vial is provided having a bead for mating in a recess in a flange in the cap whereby the cap is tightly secured to the vial. The cap is provided with a recess and complimentary slots and inner chamber whereby a panel may be slidable into and out of the cap. When the panel is fully inserted in the cap, there are no projections on the cap for facilitating removal of the cap from the vial. When fully retracted from the cap, the panel permits the user to raise the cap thus permitting access to the vial. When fully retracted, the panel may have indicia to the effect that the vial is nonchild proof.

15 Claims, 9 Drawing Figures

CHILD PROOF MEDICINE VIAL

BACKGROUND OF THE INVENTION

1. Field of the Invention

This invention pertains to medicine vials or containers of the type having child proof or safety closure means.

2. Statement of the Prior Art

The prior art shows safety locks or latches for caps of various types for containers and medicine vials. These prior art devices utilize either pins or sliding bars or pivoting latching mechanisms to secure the cap to the container. Unlike the prior art, the present invention does not use pins or sliding bars or latching mechanisms to secure the cap to the container or vial. Rather, the cap is secured to the vial by bead and recess means. To facilitate removal of the cap from the vial, a slidable panel is retracted from the cap thus facilitating raising of the cap from the vial. Representative of the prior art are the following list of patents.

| Patentee | Pat. No. | Issue Date |
|---|---|---|
| Yung et al | 3,860,135 | Jan. 14, 1975 |
| Fields | 3,923,180 | Dec. 2, 1975 |
| Lemons | 3,924,768 | Dec. 9, 1975 |
| Vere | 4,127,221 | Nov. 28, 1978 |
| Mar | 4,146,146 | Mar. 27, 1979 |

SUMMARY OF THE INVENTION

This invention provides a safety cap for medicine vials or other containers which is simple to manufacture and easy to install.

Another object of this invention is to provide a medicine vial and safety cap wherein the cap is snapped fitted by a bead and ridge arrangement onto the vial.

It is yet another object of this invention to provide a vial and safety cap therefor, the cap having edges contiguous with the vial walls whereby no projections are available to aid in removing the cap from the vial.

Yet another object of this invention is to provide a vial and cap therefor, the cap having a recess therein for reception of a slidable panel.

Still another object of this invention is to provide a vial and cap arrangement wherein the cap has a recess and opposing slots for receiving the slidable panel which has opposing flanges for insertion into the slots.

And yet another feature of this invention is to provide a vial and cap arrangement wherein a slidable panel is removable from a recess in the cap to aid in removing the cap from the vial.

These and other objects of this invention will become apparent to those skilled in the art to which it pertains from a reading of the specification when taken in light of the annexed drawings.

DESCRIPTION OF THE PREFERRED EMBODIMENT

Figure 1:
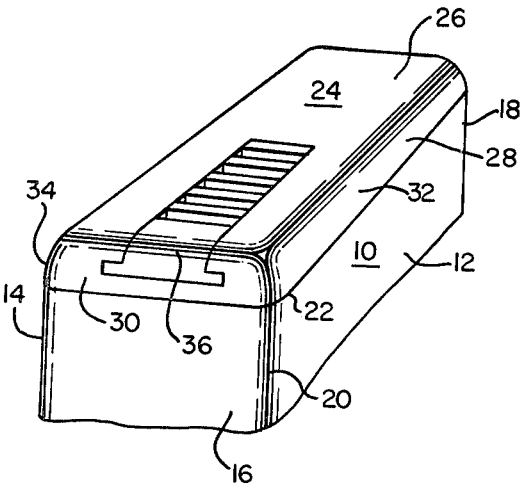
FIG. 1 is a partial perspective view of a medicine container or vial and cap arrangement, the cap showing a slidable panel therein.
Figure 2:
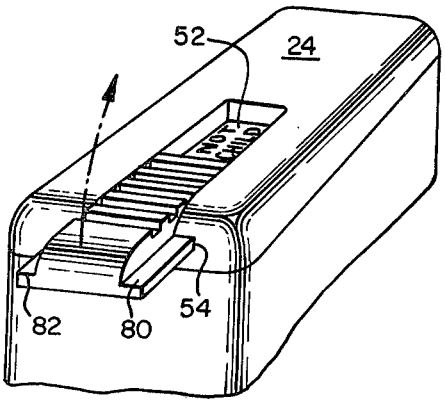
FIG. 2 is a view similar to FIG. 1, the slidable panel is shown extended or retracted out of the cap.

Referring in more detail to the drawings, FIG. 1 shows a medicine container or vial 10 having side walls 12, 14 and end walls 16, 18. Edges or corners 20 of the container or vial are rounded and terminate in a top flat edge 22. A cap 24 for the vial 10 has a top surface 26, side walls 28 (one shown) and end wall 30 (one shown).

The cap 24 has generally rounded edges 32, 34 with the edges 32 coincident with the rounded edges or corners 20 of the container. A slidable panel 36 is shown fully inserted in a recess and slots and inner chamber in the cap. These features to be more fully described below. With the slidable panel fully inserted in the recesses, slots and inner chamber in the cap, it can be readily seen that there are no projections or extending edges on the cap to permit gripping of the cap for removal of same from the vial.

Figure 3:
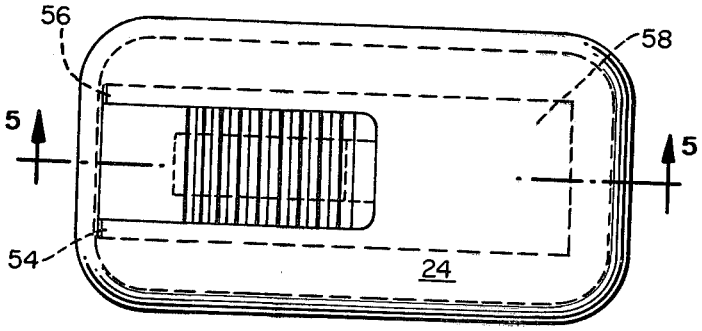
FIG. 3 is a plan view of the cap showing the panel fully inserted in the cap.
Figure 4:
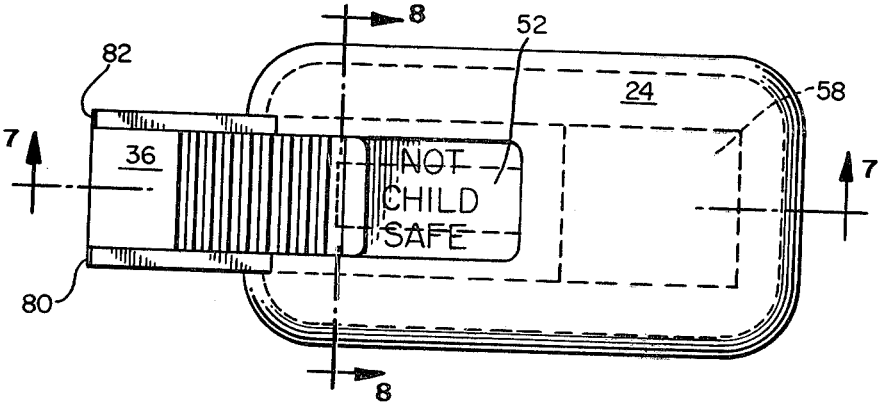
FIG. 4 is a plan view of the cap showing the panel fully retracted or extended out of the cap.
Figure 5:
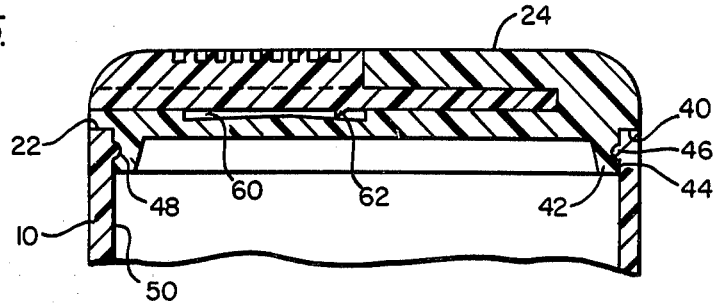
FIG. 5 is a cutaway side view of the container or vial and cap arrangement showing the cap attachment means and the slidable panel fully inserted in the cap.
Figure 7:
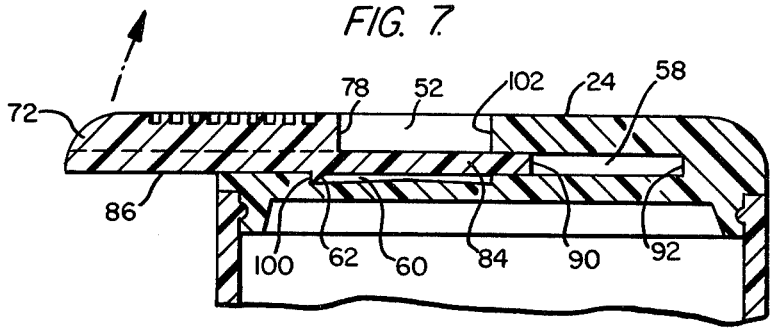
FIG. 7 is a view similar to FIG. 5 except showing the slidable panel fully retracted from the cap.
Figure 8:
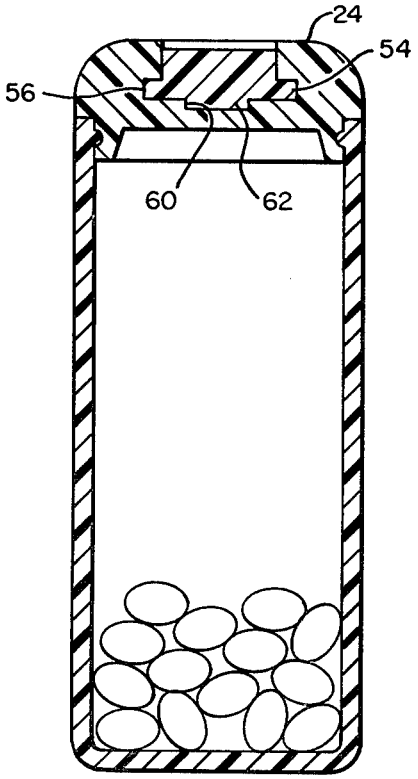
FIG. 8 is a sectional end view of the container and cap arrangement showing the slidable panel in grooves or slots in the cap.

Referring to FIGS. 5, 7 and 8, it can be seen that the cap 24 has a peripherally extending flat surface 40, downwardly extending flange 42 having an outer face 44 with a groove 46 extending about the periphery of the face 44. As can be seen, the groove 46 snaps onto beed 48 which extends peripherally about the inside wall 50 of the vial 10, a distance just below top flat edge 22. By this construction, the cap 24 is tightly held to the vial 10. Again, note in FIG. 5 that there are no projecting edges from the cap 24 to permit gripping of the cap for removal of same from the vial. Thus, a child or other person of diminished responsibility could not raise the cap from the vial permitting access to medicine therein. FIGS. 1, 3 and 5.

Figure 6:
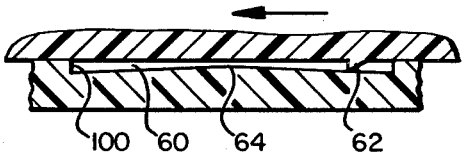
FIG. 6 is a sectional view of the cap and slidable panel and shows a depending tab or stop in a recess in the cap.
Figure 9:
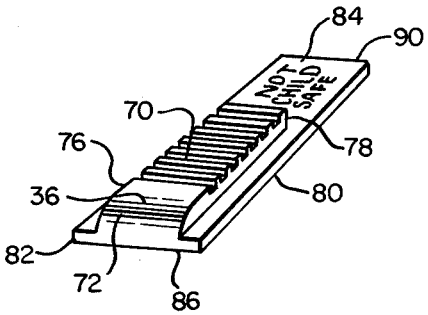
FIG. 9 is a perspective view of the slidable panel showing flanges on the sides thereof and serrations on the top surface.

Referring to FIGS. 2, 3, 4, 7 and 8, the cap 24 has a recess 52 including side guideway slots 54, 56, inner chamber 58 and depressed keyway 60. The slidable panel 36, FIG. 9, is shown to have a top serrated surface 70, curved front wall 72, side walls 74, 76, end wall 78, side flanges 80, 82 and rear tab 84. The undersurface 86, FIG. 7, is generally flat except for a depending resistance tab and stop member 62 which extends into and is as wide as the depressed keyway 60. The keyway 60, FIG. 6, may be arcuate in nature with the apex at 64 or it may slant upwardly in the direction of the arrow. This construction permits increasing resistance to forward or outward movement of the panel 36 by reason of the resistance exerted on the depending tab 62. Thus, it requires considerable pressure in the direction of the arrow to move the panel 36 outwardly of the cap 24.

Referring to FIGS. 2, 3, 4 and 7, the flanges 80, 82 of the panel 36 are inserted into slots 54, 56 of the cap 24. The panel 36 is then pushed rearwardly with the rear tab 84 extending into the inner chamber 58. The panel stops when the wall 90 of the tab 84 strikes wall 92 within the innermost end of the chamber 58. When fully inserted, the rounded face 72 of the panel 36 is complimentary or flush with the top surface 26 and edge 30 of the cap 24 whereby there are no projections on the cap to permit raising of the cap from the vial.

When the panel is fully retracted from the cap, rear tab 84 is exposed in the recess 52 and may carry indicia such as "not child resistant." Foward movement of the panel 36 is checked when the tab 62 abuts against vertical wall 100 of the keyway 60. When the panel 36 is fully inserted in the cap, wall 78, FIG. 7, abuts wall 102 whereby the recess 52 is closed and thus no indicia exposed on the slidable panel 36.

By this construction, there is provided a child safe medicine vial which requires no mechanical hooks, pins, bars or latches to prevent removal of the cap.

While the invention has been shown and described in detail with reference to a preferred embodiment thereof, it will be understood to those skilled in the art to which this invention pertains that various changes in form and detail may be made therein without departing from the spirit and scope of the invention.

What I claim is:

1. A medicine container comprising:

side walls and end walls having rounded corners;

a bead extending circumferentially of the inside of said walls near the open end thereof;

a cap having a depending flange with a groove therein for mating with said bead; and a slidable panel in the cap which, when retracted, aids in facilitating removal of the cap from the container.

2. A medicine container as defined in claim 1, wherein:

said cap having a recess therein for slidably receiving said panel.

3. A medicine container as defined in claim 1, wherein:

said cap having slots therein for slidably receiving said panel.

4. A medicine container as defined in claim 1, wherein:

said cap having an inner chamber for receiving a portion of said panel.

5. A medicine container as defined in claims 1, wherein:

said cap having a depressed keyway for receiving a depending tab on said panel.

6. A medicine container as defined in claim 5, wherein:

said keyway having resistance increasing means therein.

7. A medicine container as defined in claim 6, wherein:

said resistance increasing means being arcuate structure transversally of the keyway offering increased resistance to the tab as the panel extends outwardly of the cap.

8. A medicine container as defined in claim 6, wherein:

said resistance increasing means comprising slanting structure longitudinally of the keyway offering increased resistance to the tab as the panel moves externally of the cap.

9. A medicine container as defined in claim 1, wherein:

said cap having a recess, slots, a keyway and an inner chamber for slidably receiving said panel.

10. A medicine container as defined in claim 9, wherein:

said panel having a top serrated surface, a curved front wall, laterally extending flanges for insertion within said slots, a depending tab for cooperation with said keyway and a rear tab for cooperation with the inner chamber.

11. A medicine container as defined in claim 1, and:

said panel extendible into and out of the cap, when extended into the cap, no projections are available to aid in raising the cap from the container, when extended out of the cap, provides a lever to raise the cap off the container.

12. A medicine container as defined in claim 10, and:

said rear tab having indicia thereon instructing the user that the cap is nonchild proof when the panel is fully retracted.

13. A medicine container comprising:

side walls and end walls;

a continuous bead on the inside of the walls near the open end;

a cap having side walls and end walls;

a depending flange on the cap having a continuous ridge for mating with the bead;

a recess, slots, inner chamber and keyway in the cap; and a panel slidable in the recess, slots, interchamber and keyway.

14. A medicine container as defined in claim 13, and:

said panel extendible into the cap whereby no projections are available to aid in removing the cap from the container and slidable out of the cap to provide a projection or lever to aid in removing the cap from the container.

15. A medicine container as defined in claim 13, and:

said panel, when extended, having indicia to indicate that the cap is nonchild proof.

* * * * *